US006068368A

United States Patent [19]

Lum et al.

[11] Patent Number: 6,068,368

[45] Date of Patent: May 30, 2000

[54] METHOD AND APPARATUS FOR REDUCING INK SPREADING ON PAPER IN INKJET PRINTING

[75] Inventors: Jack Leong Hung Lum, Laurel, Md.; Dudley Albert Saville, Princeton, N.J.

[73] Assignee: The Trustees of Princeton University, Princeton, N.J.

[21] Appl. No.: 08/918,529

[22] Filed: Aug. 21, 1997

[51] Int. Cl.[7] ..... B41J 2/415

[52] U.S. Cl. ..... 347/55; 347/101; 347/102

[58] Field of Search ..... 347/55, 102, 101

[56] References Cited

U.S. PATENT DOCUMENTS

| | | | |
|---|---|---|---|
| 3,909,831 | 9/1975 | Marchio et al. | 346/140.1 |
| 4,014,693 | 3/1977 | Clark | 347/55 |
| 4,238,807 | 12/1980 | Bovio et al. | 347/88 |
| 4,717,926 | 1/1988 | Hotomi et al. | 347/55 |
| 4,737,803 | 4/1988 | Fujimura et al. | 347/67 |
| 5,144,340 | 9/1992 | Hotomi et al. | 347/55 |
| 5,266,098 | 11/1993 | Chun et al. | 75/335 |
| 5,306,412 | 4/1994 | Whitehouse et al. | 204/452 |
| 5,517,223 | 5/1996 | Shin | 347/38 |
| 5,923,346 | 7/1999 | Mills et al. | 347/11 |
| 6,013,347 | 1/2000 | Martin et al. | 428/92 |

OTHER PUBLICATIONS

M. Trau, S. Sankaran, D. A. Saville & I. A. Aksay; "Electric–field–induced pattern formation in colloidal dispersions"; *Letters To Nature*; vol. 374; Mar. 30, 1995; pp. 437–439.

D. A. Saville; "Electrohydrodynamic Deformation of a Particulate Stream by a Transverse Electric Field"; *Physical Review Letters*; vol. 71, No. 18; Nov. 1, 1993; pp. 2907–2910.

A. W. Adamson; "Wetting, Flotation, and Detergency"; *Physical Chemistry of Surfaces*; Fifth Ed.; John Wiley & Sons, Inc., New York; 1990; pp. 493–497.

Albert E. Seaver and John C. Berg; "Spreading of a Droplet on a Solid Surface"; *Journal of Applied Polymer Science*; vol. 52, 431–435 (1994).

J. Fukai, Y. Shiiba, T. Yamamoto, O. Miyatake; D. Poulikakos, C. M. Megaridis, and Z. Zhao; "Wetting effects on the spreading of a liquid droplet colliding with a flat surface: Experiment and modeling"; *Phys. Fluids* 7 (2), Feb. 1995; pp. 236–247.

Akira Asai, Makoto Shioya, Shinichi Hirasawa, and Takeshi Okazaki; "Impact of an Ink Drop on Paper"; 1993, IS & T —*Journal of Imaging Science and Technology*; pp. 205–207.

Osman A Basaran and L.E. Scriven; "Axisymmetric Shapes and Stability of Pendant and Sessile Drops in an Electric Field"; *Journal of Colloid and Interface Science*; vol. 140; No. 1; Nov. 1990; pp. 10–31.

A. Ramos and A. Castellanos; "Equilibrium shapes and bifurcation of captive dielectric drops subjected to electric fields"; *Journal of Electrostatics*; 1994 Elsevier Science B.V.; SSDI 0304–3886 (93) E0046–K; pp. 61–86.

*Primary Examiner*—John Barlow
*Assistant Examiner*—Christina Annick
*Attorney, Agent, or Firm*—Kenneth Watov; Watov & Kipnes, P.C.

[57] ABSTRACT

An inkjet printer is described in which ink is prevented from spreading on paper by application of an electric field between an inkjet printhead and the paper.

13 Claims, 6 Drawing Sheets

METHOD AND APPARATUS FOR REDUCING INK SPREADING ON PAPER IN INKJET PRINTING

BACKGROUND OF THE INVENTION

Currently, inkjet printers and copiers work by a cartridge or inkjet printhead ejecting a small amount of ink onto a desired location on a piece of paper. The ink droplet of micron dimensions first impacts the paper and then wets or spreads on the surface of the paper because of surface tension. Oftentimes, due to the strong absorbency and roughness of paper, the ink may spread excessively and unevenly, causing the shape of the droplet as seen from above to diverge undesirably from a compact, well-formed circle (see FIG. 1B). The ink dot upon drying may be noncircular and rough, and the overall printed image grainy instead of sharp.

A number of things can be done to reduce the amount of spreading. The paper can be coated with a thin film, for example, on which the ink droplet spreads poorly. This type of paper, usually sold as "glossy" paper, produces excellent laser-quality print but is also very expensive when compared against "plain" copier or bond paper. Another solution involves changing the properties of the ink, such as increasing its viscosity to reduce spread or choosing its solvent to hasten drying and thereby freeze the droplet before it can spread. However, in many cases, ink with such properties tends to clog the cartridges and mechanisms, thereby decreasing the life of ink cartridge.

BRIEF DESCRIPTION OF THE INVENTION

To improve the quality of a dot from an inkjet printer in a cost-effective, yet practical manner, the spreading of an inkjet droplet on plain paper is prevented in accordance with this invention through the use of an applied electric field.

In one embodiment of this invention, an ink droplet is ejected onto a desired location on the paper, and electrodes are provided that sit directly below and above this location. An electric voltage is applied between the electrodes so as to produce an electric field that causes the droplet to form into a cone while it is drying. The cone does not spread on paper because it is being held in that particular shape by an electrohydrodynamic force.

In another embodiment of the invention an ink droplet is suspended from a ejector and formed into a liquid bridge extending to the paper by an electric field established between the ejector and an electrode on the other side of the paper. The electric field is maintained at least until the ink has dried sufficiently not to spread. In some cases it may be advantageous to suck some of the ink away from the liquid bridge before it is dried.

As long as the conductivity of the fluid in the ink is higher and its dielectric constant is greater than the conductivity and dielectric constant of the surrounding fluid, usually air, the ink in an applied electric field will be acted upon by electrohydrodynamic forces. In the case where a droplet of ink is ejected onto the paper, these forces will form the droplet into a cone having its apex pointing toward the ejector. In the case where a droplet of ink is suspended from the ejector, these forces will form it into either a cone with a small rod extending from its apex to the paper, or a cone, or a cylinder depending on the strength of the electric field. The speed at which it deforms is determined by the differences in conductivity and dielectric constant, the strength of the field, the viscosity of the droplet and the separation between the two electrodes. If the ink is allowed to dry or is dried by a heating unit, air convection or some other means in its columnar or cone shape, the shape of the dot as seen from above should be circular, fairly small and sharp. It is important to note here that the primary purpose of this process is to hinder the spreading of the ink between the time it contacts the paper and the time when it has dried sufficiently that it will not spread without the presence of an electric field.

The process can work with almost any liquid based ink whether it is water-based, oil-based or solvent-based. As mentioned above, the fluid motion of the ink droplet is opposite to the spreading by surface tension as long as the dielectric constant and conductivity of the droplet exceeds those of the surrounding medium. In an inkjet printer, the surrounding medium is air, and most inks easily have larger conductivities and dielectric constants than air. Where a type of ink has an initial conductivity lower than the surrounding medium, it can be doped with small amounts of soluble organic salts, for example, tetrabutyl-ammonium tetraphenylborate, TBATPB. Under conditions where an ink droplet has a lower initial dielectric constant than its surrounding medium, the ink can be mixed with particles of high dielectric constant, for example, barium titanate particles or $BaTiO_3$. When the surrounding medium is air, the most common shape that an ejected droplet will take is a cone pointing in the direction of the applied field. Ink mixtures which are extremely low in density and high in conductivity may theoretically yield columns instead of cones.

BRIEF DESCRIPTION OF THE DRAWINGS

Various embodiments of the present invention are described and illustrated with reference to the accompanying drawings, in which like items are indicated by the same reference designation, wherein.

DETAILED DESCRIPTION OF THE INVENTION

Figure 1A:
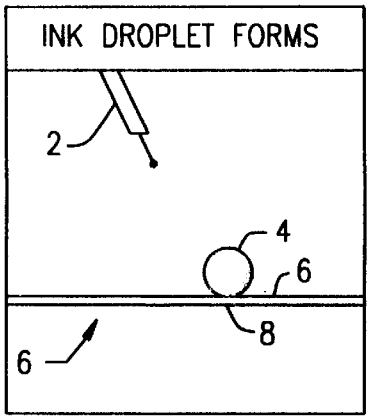
PRIOR ART FIG. 1A
FIGS. 1A, 1B, and 1C are side views illustrating what happens in the prior art to an ink droplet ejected onto a sheet of paper as the ink dries.
Figure 1B:
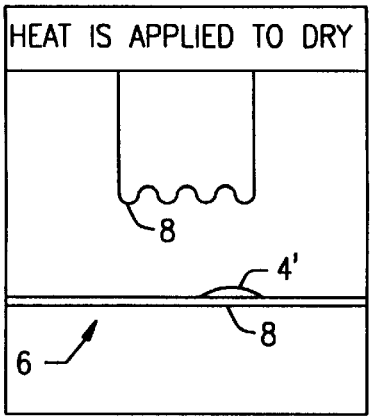
PRIOR ART FIG. 1B
Figure 1C:
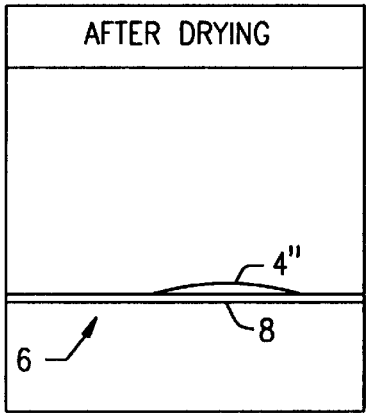
PRIOR ART FIG. 1C
Figure 1D:
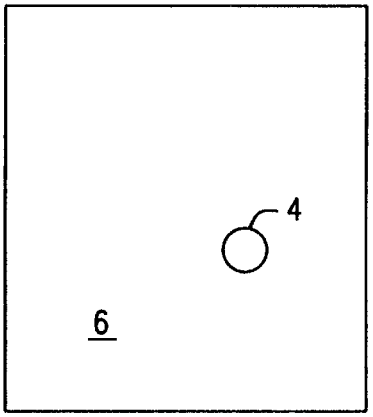
PRIOR ART FIG. 1D
FIGS. 1D, 1E, and 1F are top views illustrating what happens in the prior art to an ink droplet ejected onto a sheet of paper as the ink dries.
Figure 1E:
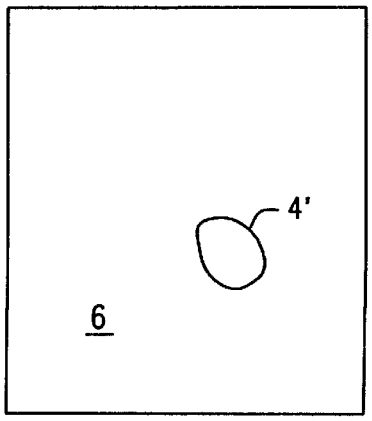
PRIOR ART FIG. 1E
Figure 1F:
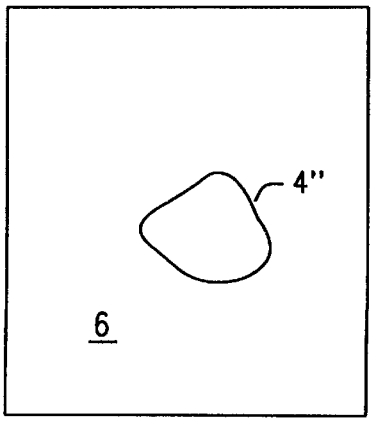
PRIOR ART FIG. 1F

As shown in FIG. 1A, an inkjet printer of the prior art involves the use of an ejection device 2 for projecting an initial droplet 4 of ink, which is approximately spherical, onto a sheet 6 of paper. During drying (see FIG. 1B), the initial droplet 4 spreads outwardly on the paper so as to form a dome 4', and when the drying is finished, the ink is in the shape of a flattened dome 4" (see FIG. 1C). Because the ink in the droplet 4 spreads unevenly from its point 8 of initial contact, the top views of the droplets 4' and 4" in FIGS. 1E and 1F, respectively, are far from circular so as to significantly reduce the resolution that may be attained, relative to the droplet 4 of FIG. 1D before spreading.

Figure 2:
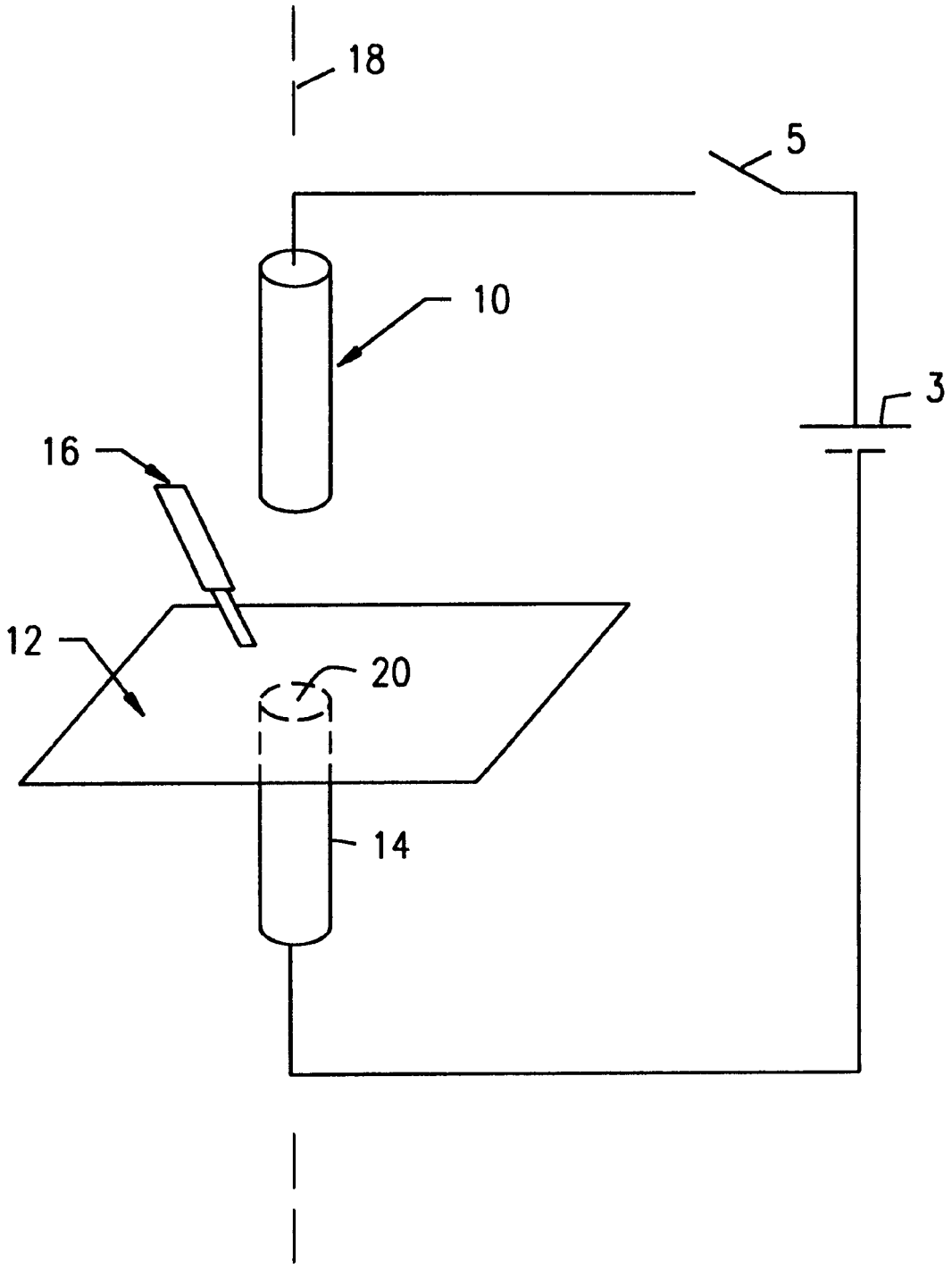
FIG. 2 illustrates an inkjet printer of the invention in which ink is ejected onto paper at an angle with the axis of the electrodes and subjected to an electric field.

FIG. 2 is a schematic representation of an inkjet printer capable of being used in accordance with this invention in which an electrode 10 is shown as being spaced from one side of a sheet of paper 12 and an electrode 14 is shown as being in contact with its other side. A battery 3 and a switch 5 are connected in series between the electrodes 10 and 14. An ink ejection device 16 ejects ink at an angle with the axis 18 of the electrodes 10 and 14 so as to deposit an initial droplet 20 onto the side of the sheet of paper 12 facing the electrode 10.

Figure 3A:
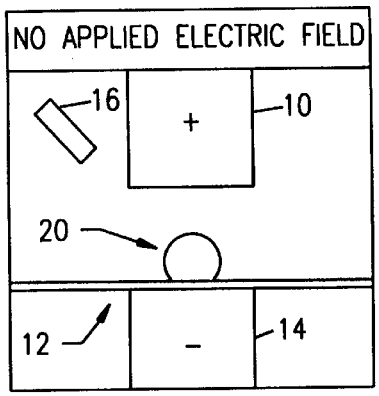
FIGS. 3A, 3B, and 3C illustrate the operation of the printer of FIG. 2 by showing cross-sectional views of an initial ink droplet on a sheet of paper with no applied electric field, a cone formed from the ink droplet by an electric field, and the hardened cone formed by drying, respectively.
Figure 3B:
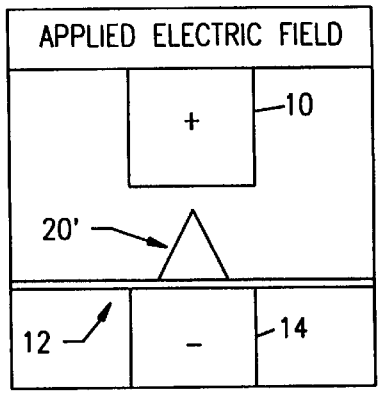
Figure 3C:
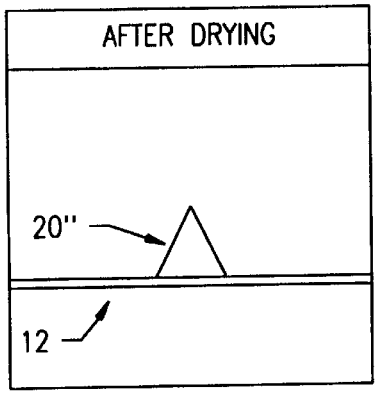

As shown in FIG. 3A, when no electric field is formed between the electrodes 10 and 14 of FIG. 2, the initial droplet 20 approximates a sphere just like the initial droplet 4 of FIG. 1A. In accordance with the invention, an electric field of the indicated polarity may then be applied between the electrodes 10 and 14 by closing the switch 5 so that instead of spreading outwardly, as illustrated by the domes 4' and 4" of FIGS. 1B and 1C, respectively, the ink of the initial droplet 20 forms a cone 20' (see FIG. 3B), which is known as a Taylor cone. While the electric field is applied, the ink in the cone 20' is dried or permitted to dry sufficiently to prevent the ink from spreading. When the drying is completed (see FIG. 3C), the electric field provided by the electrodes 10 and 14 is removed so as to leave a hardened cone 20" of ink on the paper 12.

Figure 4:
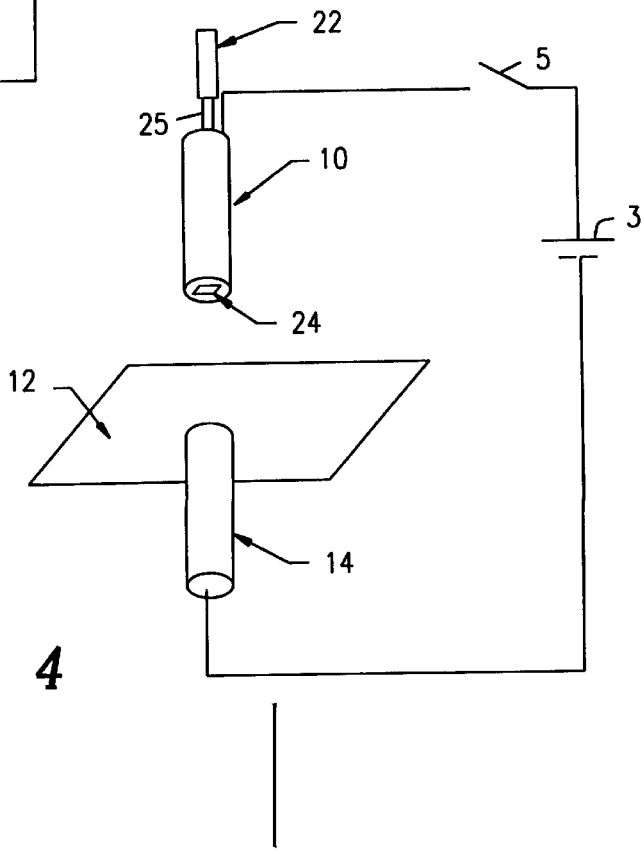
FIG. 4 illustrates an inkjet printer of the invention in which ink is ejected or suspended from an ejection chamber within one of the electrodes providing an electric field.

FIG. 4 shows an inkjet printer of this invention in which components corresponding to these in FIG. 2 are designated in the same way. It differs from the device of FIG. 2 by the type of ink ejector used. Instead of the ink ejector being on one side, as is the case with the ink ejector 16 of FIG. 2, an inkjet droplet ejection device 22 forces a given amount of ink through an ejection chamber 24 in the upper electrode 10. The ejection device 22 shown as a piston 25 that is capable of forcing ink from the chamber 24 or of sucking back excessive ink from ink forming a liquid bridge between the electrode 10 and the paper 12. If the piston 25 is advanced and withdrawn quickly, a droplet of ink can be ejected onto the paper 12. Air pressure applied to the chamber 24 could operate in the same way.

Figure 5A:
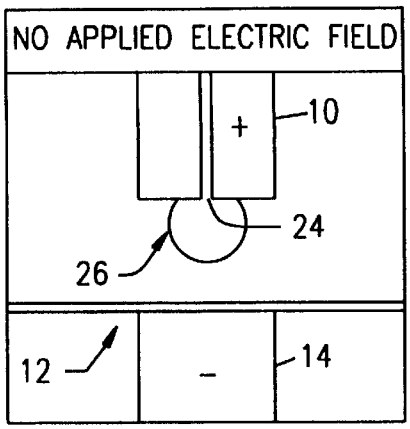
FIGS. 5A, 5B, and 5C illustrate the operation of the inkjet printer of FIG. 4 with no applied electric field, with an applied electric field before drying, and after drying of the ink, respectively, to form a rod of dried ink.
Figure 5B:
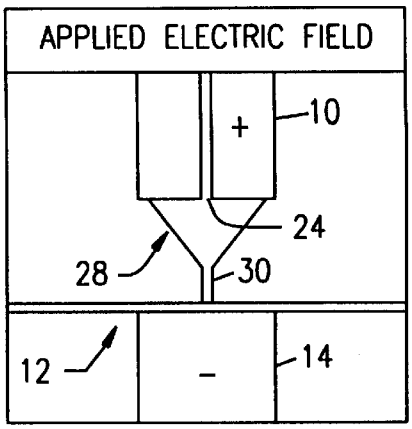
Figure 5C:
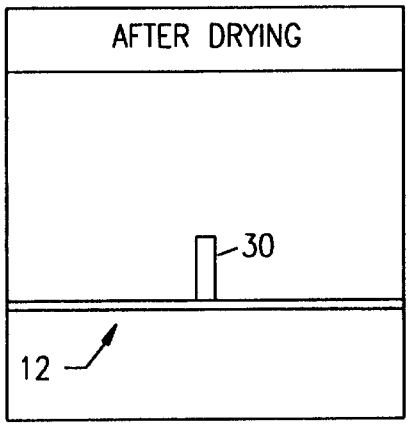

FIGS. 5A, 5B, and 5C illustrate one way of using the apparatus of FIG. 4 in accordance with the invention. With no electric field between the electrodes 10 and 14, the ejection device 22 is operated so as to cause a droplet 26 to be suspended from the bottom of the ejection chamber 24 as in FIG. 5A. A D.C. electric field of the indicated polarity (see FIG. 5B) is then applied so as to create a cone 28 having a rod 30 extending from its smaller end to the paper 12 so as to form a liquid bridge. The ink in the cone 28 is sucked back into the ink ejection chamber 24 by raising the piston 25 so as to leave the rod 30 to dry on the paper 12 (see FIG. 5C). The rod 30 has a very small diameter so as to permit printing with a high degree of resolution. The rod 30 at the end of the cone 28 occurs when the distance between the electrodes 10 and 14 is so large that the cone 28 cannot form a liquid bridge between them. This occurs when the electrical forces on the droplet 26 are not strong enough to deform the whole droplet into a cone so that the top of the cone pushes out liquid to form the small rod 30.

Figure 6A:
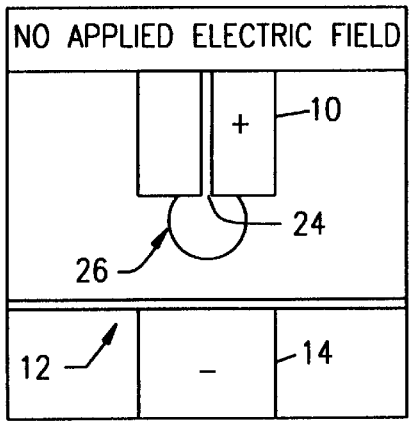
FIGS. 6A, 6B, and 6C illustrate the operation of an inkjet printer such as shown in FIG. 4 with no applied electric field, with an applied electric field, and after drying of the ink, respectively, to form a cone of dried ink on the paper.
Figure 6B:
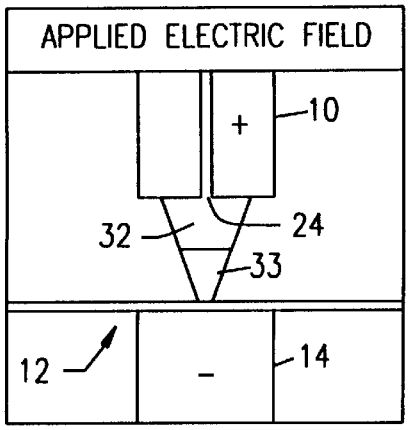
Figure 6C:
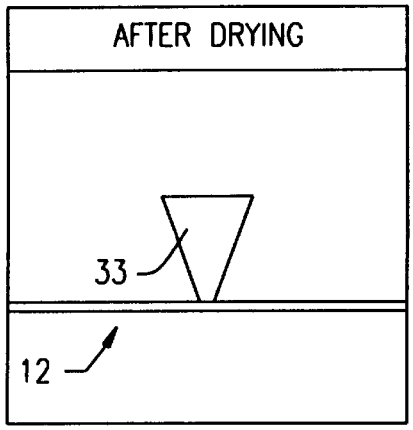

FIGS. 6A, 6B, and 6C illustrate another way of using apparatus like that of FIG. 4. With no electric field applied between the electrodes 10 and 14 (see FIG. 6A), the droplet 26 is suspended from the bottom of the ejection chamber 24 as in FIG. 5A. A D.C. electric field of the indicated polarity is then applied so as to form a cone 32 that forms a liquid bridge to the paper 12 (see FIG. 1B). Ink may then be sucked back into the chamber 24 by raising the piston 25, and after the remaining portion 33 of the cone is dried, at least to a point where it will not flow and spread, it is left on the paper 12 (see FIG. 6C).

Figure 7A:
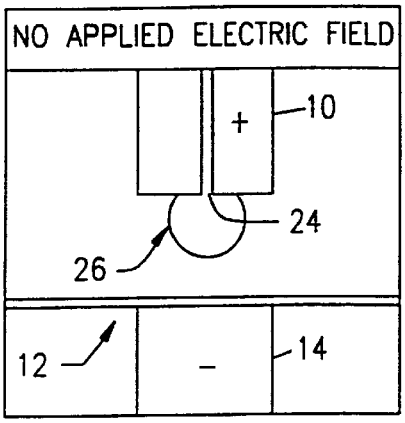
FIGS. 7A, 7B, and 7C illustrate the operation of the inkjet printer of FIG. 4 showing a droplet of ink just emerging from a chamber with no applied electric field, a column formed from the droplet by an applied electric field, and a dried column of ink, respectively.
Figure 7B:
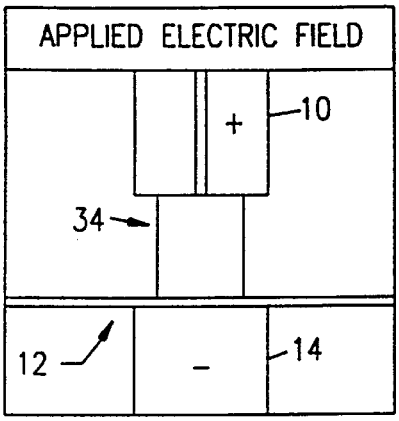
Figure 7C:
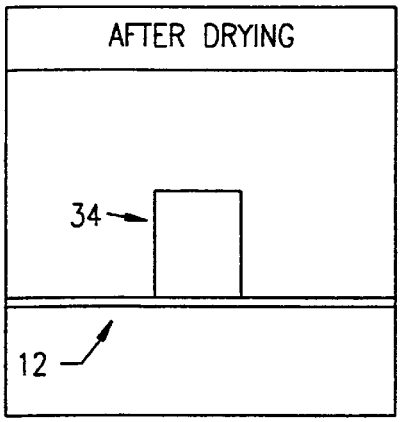

FIGS. 7A, 7B, and 7C illustrate another application of this invention to a device such as shown in FIG. 4. Initially, no electric field is applied between the electrodes 10 and 14 so that the ink droplet 26 is suspended from the ejection chamber 24 (see FIG. 7A). When a suitable electric field of the polarity shown is formed between the electrodes 10 and 14, the ink in the droplet 26 may be formed into a liquid bridge in the form of a cylindrical column 34 extending between the electrode 10 and the paper 12 (see FIG. 7B). Ink may be drawn from the ink chamber 24 by raising the piston 25.

Whether or not ink is withdrawn, all of the ink in the column 34 is dried or permitted to dry at least to a point where no spreading will occur before the electric field between the electrodes 10 and 14 is removed, thereby leaving a hardened column 34 on the paper 12 (see FIG. 7C).

Figure 8:
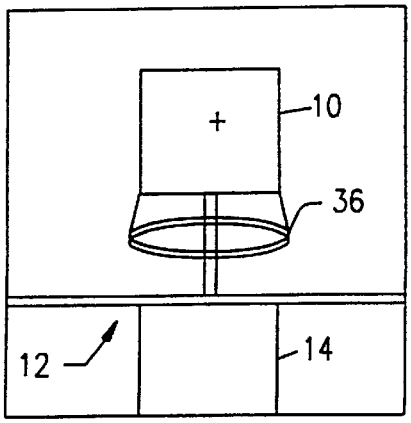
FIG. 8 illustrates an inkjet printer of the invention in which the ejected ink is dried by a heater.
Figure 9:
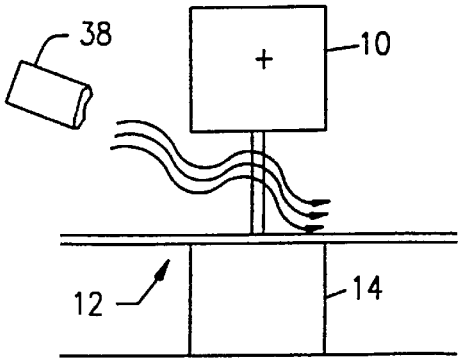
FIG. 9 illustrates an inkjet printer of the invention in which the ejected ink is dried with a flow of air.

In the apparatus of either FIG. 2 or FIG. 4, ink between the electrode 10 and the paper 12 may be dried by provision of a heating ring 36 between the electrode 10 and the paper 12 as shown in FIG. 8. Alternatively, the ink can be dried by using a blower 38, as shown in FIG. 9, to blow dry warm air gently around it.

Figure 10:
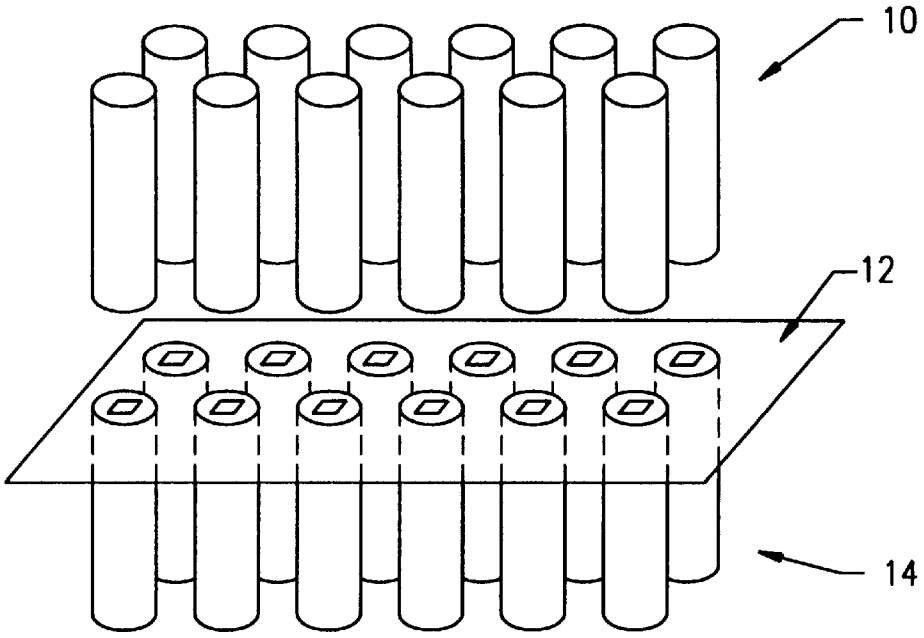
FIG. 10 illustrates a printhead that may be formed with a plurality of inkjet ink droplet ejectors.

FIG. 10 illustrates an inkjet printhead made from a plurality of devices such as shown in FIG. 4 having upper electrodes 10, lower electrodes 14, and means, not shown, for ejecting ink onto the paper 12 between the electrodes 10 and their respective opposing electrodes 14.

Figure 11:
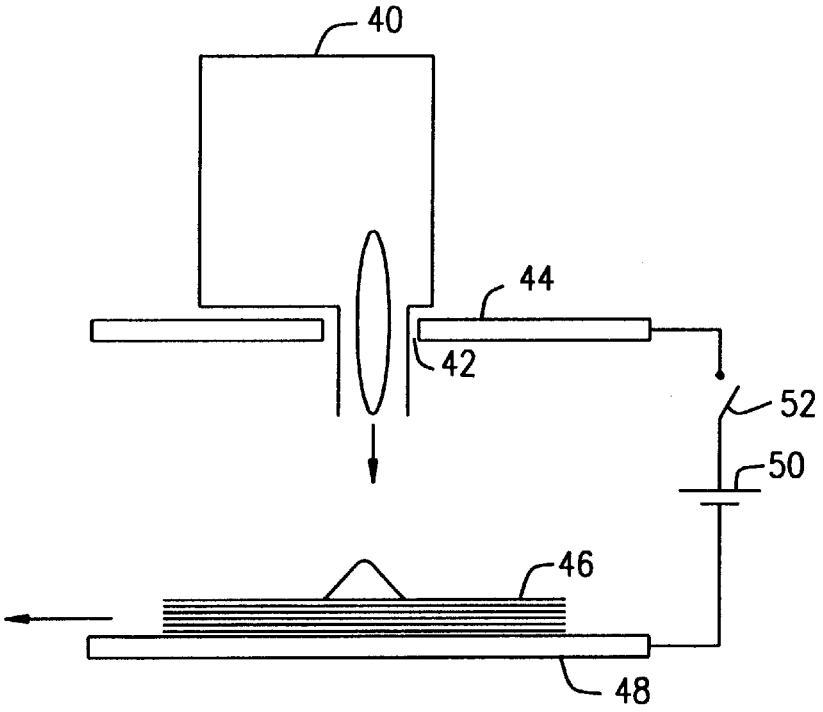
FIG. 11 shows an inkjet printhead positioned in a slit in a top electrode.

FIG. 11 illustrates another embodiment of the invention in which a standard piezoelectric or thermal drop-on-demand inkjet printhead 40 is free to move back and forth along a slit 42 in an electrode 44 that extends across a sheet of paper 46. The sheet of paper 46 is placed on an electrode 48, and a battery 50 or other DC source of voltage is connected in series with a switch 52 between the electrodes 44 and 48. The printhead 40 ejects a droplet of ink onto the paper 46. In normal operation, the switch 50 will remain closed. The advantage of this structure is that the electric field between the electrodes 44 and 48 can always be maintained while the printhead 40 moves across the paper 46 in the slit 42, and while the paper 46 is advanced to allow the printhead 40 to print on another line.

When ink is ejected across the space between the electrode 10 and the paper 12 of FIGS. 2 and 4, the electric field may be present rather than being switched on as described so as to operate like the printer of FIG. 11. This is an alternative method of operation of FIGS. 2 and 4.

Although various embodiments of the invention are shown and described herein, they are not meant to be limiting. Those of skill in the art may recognize certain modifications to these embodiments, which modifications are meant to be covered by the spirit and scope of the appended claims. For example, the polarity of the DC voltage sources shown in the drawings can be reversed, or an AC voltage supply can be used, for obtaining the same result.

What we claim is:

1. An ink jet printer comprising: first and second spaced electrodes; means for depositing ink onto paper located between the electrodes; and means for applying voltage between said electrodes so that ink deposited onto the paper is subjected to an electric field which is maintained to keep the ink from spreading until the ink dries sufficiently to prevent spreading.

2. The inkjet printer as set forth in claim 1 wherein said means for depositing ink onto the paper ejects a droplet of ink at an angle with respect to an axis through said first and second electrodes are positioned.

3. The inkjet printer as set forth in claim 1 wherein said means for depositing ink onto the paper is comprised of:

an ink chamber within one of said electrodes; and means for forcing ink to be ejected from said ink injection chamber.

4. The inkjet printer as set forth in claim 3 wherein the electric field causes the ink deposited onto the paper to assume the form of a cone having a rod extending from its apex.

5. The inkjet printer as set forth in claim 3 wherein the electric field causes the ink deposited onto paper to assume the form of a cone.

6. The inkjet printer as set forth in claim 3 wherein the electric field is such as to cause the ink deposited onto paper to assume the form of a column between said first electrode and the paper.

7. The inkjet printer as set for in claim 6 wherein:

means are provided for sucking ink from said column before the ink dries.

8. A method for printing ink on paper comprising the steps of:

ejecting a droplet ink onto paper;

establishing an electric field having a component perpendicular to the paper and passing through the ink droplet on the paper; and maintaining said electric field until ink in contact with the paper has dried to a point where it will not spread.

9. An inkjet printer comprising:

a first electrode having a chamber therein; a second electrode spaced from said first electrode;

means for ejecting ink from said first electrode toward said second electrode; and means for establishing and maintaining an electric field between said electrodes to keep the ink from spreading on paper located between the first and second electrodes, until the ink dries sufficiently.

10. An inkjet printer as set forth in claim 9, wherein said means for ejecting ink includes means for withdrawing ink from ink suspended from it.

11. An inkjet printer as set forth in claim 9 further comprising a heater in the form of a ring through which ink is ejected.

12. A method for printing ink on paper comprising the steps of:

suspending a droplet of ink from a first electrode;

placing paper between a second electrode and said first electrode;

producing an electric field between said first and second electrodes so as to form said droplet into a liquid bridge between said first electrode and said paper; and maintaining said electric field until the ink in the bridge has dried sufficiently to prevent spreading.

13. An inkjet printer comprising:

a first planar electrode having a slit therein; a second planar electrode spaced from said first electrode; an ink ejector mounted so as to slide along said slit, said ejector being adapted to eject ink toward said second electrode; and means for providing and maintaining an electric field between said first and second electrodes until ink on paper located between the first and second electrodes dries sufficiently to prevent spreading of ink.

* * * * *

UNITED STATES PATENT AND TRADEMARK OFFICE

CERTIFICATE OF CORRECTION

PATENT NO. : 6,068,368
DATED : May 30, 2000
INVENTOR(S) : Lum, et al.

It is certified that error appears in the above-identified patent and that said Letters Patent is hereby corrected as shown below:

Please add the following section before the first sentence in the application:

-- GOVERNMENT RIGHTS
The present invention has been sponsored by NASA under a federal grant, and the government may have certain rights to the subject invention. --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*